US005586737A

United States Patent [19]

van Alstine et al.

[11] Patent Number: 5,586,737

[45] Date of Patent: Dec. 24, 1996

[54] SWITCH MACHINE CAM BAR

[75] Inventors: Daniel W. van Alstine, Rochester; Charles M. Eggebrecht, Churchville, both of N.Y.

[73] Assignee: General Railway Signal Corporation, Rochester, N.Y.

[21] Appl. No.: 624,186

[22] Filed: Mar. 28, 1996

Related U.S. Application Data

[63] Continuation of Ser. No. 293,127, Aug. 19, 1994, abandoned.

[51] Int. Cl.[6] ..... E01B 7/00

[52] U.S. Cl. ..... 246/448; 246/401

[58] Field of Search ..... 246/393, 395, 246/396, 397, 398, 399, 400, 401, 404, 448, 253; 403/325, 321

[56] References Cited

U.S. PATENT DOCUMENTS

| | | | |
|---|---|---|---|
| 998,525 | 7/1911 | Kaltschmidt | 246/448 |
| 1,071,798 | 9/1913 | Rollings et al. | 246/448 |
| 1,976,829 | 10/1934 | Bone | 246/448 |
| 1,976,830 | 10/1934 | Bone et al. | 246/448 |
| 2,019,189 | 10/1935 | Whirter et al. | 246/401 |
| 2,022,359 | 11/1935 | McWhirter | 246/401 |
| 2,082,142 | 6/1937 | Bone | 246/448 |
| 2,337,636 | 12/1943 | Bone et al. | 246/401 |
| 3,652,849 | 3/1972 | Kleppick | 246/393 |
| 4,896,850 | 1/1990 | Carmes | 246/401 |

*Primary Examiner*—Mark T. Le

*Attorney, Agent, or Firm*—Ohlandt, Greeley, Ruggiero & Perle

[57] ABSTRACT

There is provided a cam bar of a railroad track switch machine for locking a lock bar at a particular position. Specifically, a cam bar latch interconnects a locking section, for interlocking with the lock bar, to a positioning section, for controlling the position of the locking section. For normal operations, the cam bar latch holds the two sections together. For abnormal conditions, when the cam bar is not able to lock the lock bar into position, the cam bar latch allows the two sections of the cam bar to separate and reconnect interchangeably. Thus, the positioning section may continue to move freely regardless of whether the lock bar is locked or not, and yet, control the position of the locking section when a normal condition returns. Also, the cam bar prevents an indicating means of the switch machine from indicating a "safe condition" when the two sections are separated, i.e., when an abnormal condition exists.

17 Claims, 3 Drawing Sheets

SWITCH MACHINE CAM BAR

This is a continuation of application Ser. No. 08/293,127, filed on Aug. 19, 1994, now abandoned.

RELATED APPLICATIONS

Reference is made to U.S. patent application Ser. No. 08/293,126, which was filed on Aug. 19, 1994, titled POINT DETECTION AND INDICATION WITH LATCH OUT MEANS, now abandoned and U.S. patent application Ser. No. 08/293,121, which was filed on Aug. 19, 1994, titled LOW PROFILE SWITCH MACHINE, now U.S. Pat. No. 5,494,242, that relate to art similar to the present application and are commonly owned by the applicant.

BACKGROUND OF THE INVENTION

1. Field of the Invention

The present invention relates generally to switch devices for switching the positions of railway tracks in order for trains to move from one track to another. More particularly, the present invention relates to a cam bar of a railroad track switching machine that permits the switch machine to continue operating, even when a lock bar of the switch machine is not able to lock into its proper position.

2. Description of the Prior Art

A switch machine is commonly used to perform a switching operation of a train from one railroad track to another. The switch machine controls the switching operation by connections to the railroad tracks through a throw bar, lock bar, and point detector bar. The throw bar throws a pair of inner tracks, located between a pair of stock rails, from one track position to another. The lock bar locks the inner tracks after the throw bar has switched them into position. The point detector bar determines whether the inner tracks have moved to a proper position. If so, a point detector system indicates a "safe condition" to a local or remote operator.

Normally, an electric motor provides the switch machine with the power required to throw the inner tracks from one position to another. However, there are certain situations when utilizing the electric motor is not possible or less than favorable, such as when communication between the switch machine and a remote control location is lost or a failure inside the switch machine prevents normal operation. In such situations, a hand throw operation of the switch machine permits maintenance personnel to manually switch the tracks by throwing a hand throw switch.

Similar to a normal situation when the electric motor is used, the lock bar of the switch machine locks the position of the inner tracks after they have been thrown by the hand throw switch. Also, a hand throw arm is positioned in a latch stand and padlocked thereto in order to prevent unauthorized personnel from throwing the hand throw switch.

Switch machines and their associated railroad tracks are operated in very hostile environments. Commonly, hazards and damage to a switch machine and its tracks prevents them from operating normally. When an electric motor does not throw the inner tracks as requested by an operator, operational personnel may resort to hand throwing the tracks. However, if the switch machine or its tracks has been damage in a manner that prevents the lock bar from operating properly, completion of the hand throw operation may not be possible and the operation of trains through that vicinity will be tied up until the problem is fixed. This type of delay can result in costly financial losses for railroad operators and owners.

Therefore, it is the purpose of the present invention to provide a device that will permit a hand throw operation to be completed even when its lock bar does not properly lock its associated inner tracks into position. This device permits trains to pass through railroad tracks associated with the switch machine with the switch points otherwise secured until the problem can be corrected.

Accordingly, it is a primary object of the present invention to overcome the aforenoted problem associated with operating a railroad network when the lock bar of a switch machine is not operating properly.

Another object of the present invention is to provide an override provision of a switch machine for operating the throw bar to switch the railroad tracks even though the lock bar does not properly lock the tracks in position.

A further object of the present invention is to prevent a malfunction of the lock bar and its operation from interfering with the hand throw operation of manually throwing the railroad tracks.

Yet another object of the present invention is to prevent an indicator means of a switch machine from indicating a "safe condition" when the lock bar is not operational.

Still another object of the present invention is to provide an override provision of a switch machine when the lock bar is not operational, having the ability to automatically return to its normal operation once the problem with the lock bar has been cleared or fixed.

SUMMARY OF THE INVENTION

In fulfillment of the above stated and other objects, the problem noted above has been overcome by separating the cam bar of the switch machine into two separate but interlockable sections. One end of the cam bar is controlled by either the electric motor or hand throw bar, while the other end interlocks with the lock bar. By separating the two ends of the cam bar, the electric motor or hand throw bar may continue to control one end of the cam bar without hindrance regardless of whether or not the other end is successful in interlocking with the lock bar.

Briefly described then, a preferred embodiment of the present invention is defined as follows. A cam bar of a railroad track switch machine for locking a lock bar, comprising: a positioning section, a locking section having a locking position for locking the lock bar, means, located on the locking section, for interlocking the locking section to the positioning section, and the interlocking means being operative to allow the positioning section to separate from the locking section when the locking section is prevented from moving to the locking position.

Other and further objects, features and advantages of the present invention will be understood by reference to the following description in conjunction with the annexed drawings, wherein like parts have been given like numbers.

DETAILED DESCRIPTION OF THE PREFERRED EMBODIMENT

Figure 1:
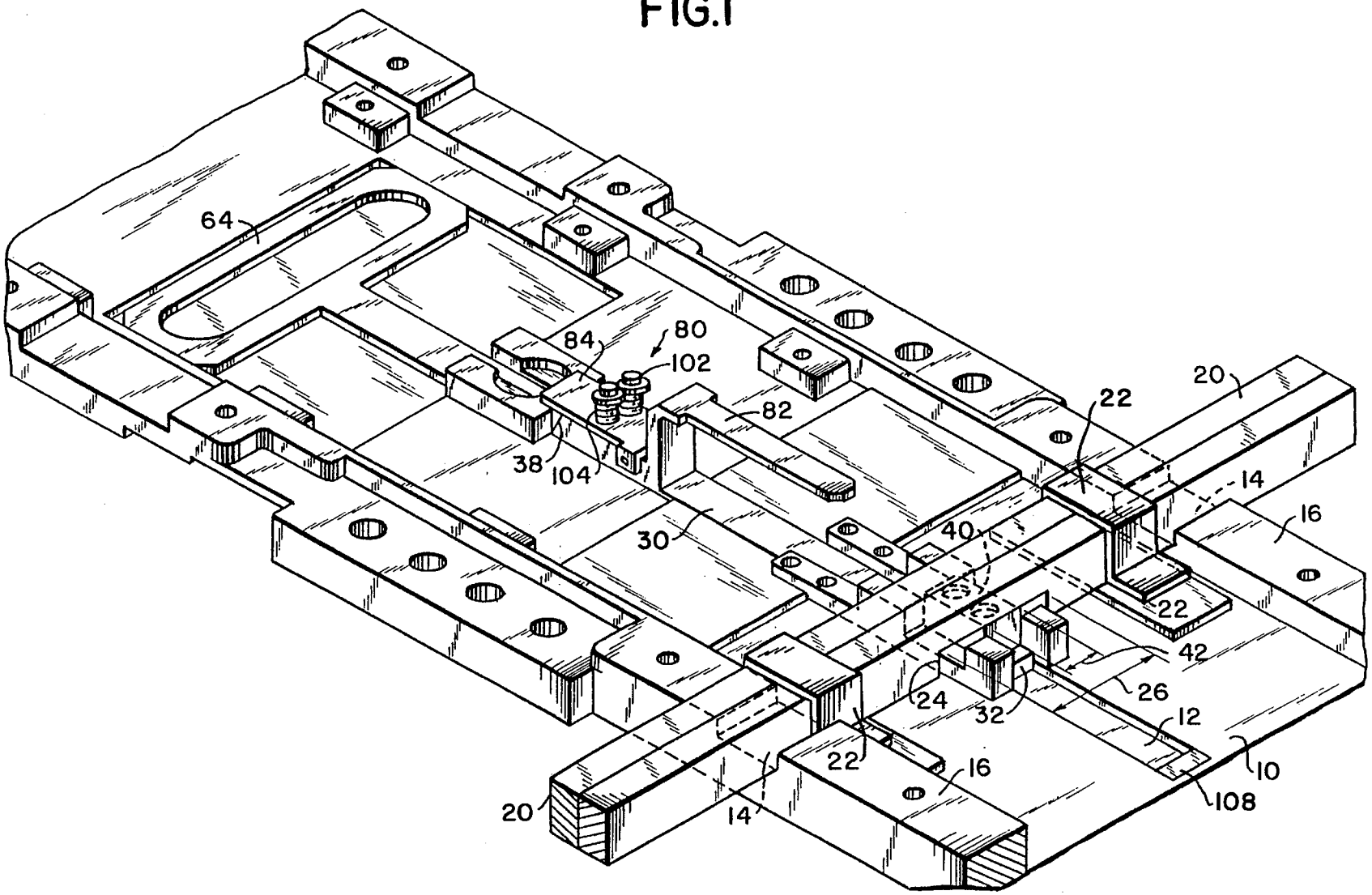
FIG. 1 is a perspective view of a cam bar positioned on the base plate of the preferred embodiment showing a lock bar positioned over an end portion of the cam bar.

Referring to the figures and, in particular, FIG. 1, there is shown a preferred embodiment of the switch machine having a base plate generally represented by reference numeral 10. For FIG. 1, the cover and several of the inner components that attach to the base plate 10 have been omitted in order to more clearly show the primary components of the preferred embodiment. Specifically, FIG. 1 shows a cam bar 30 positioned within a base groove 12 of the base plate 10 and a lock bar 20 positioned, perpendicular to, and over a lug end 32 of, the cam bar 30.

Referring to FIG. 1, the lock bar 20 is supported from below and at its lower sides by a pair of supporting notches 14 formed on opposite sides of the outer rim 16 of the base plate 10. The lock bar 20 is supported from above and at its upper sides by a pair of supporting brackets 22 that are secured to upper surface of the base plate 10, just inside the supporting notches 14.

A lock bar notch 24 is formed at a portion of the lower half of the lock bar 20, having a length 26 that is long enough allow a lock lug 40, located at the lug end 32 of the cam bar 30, to slide therein. As shown in FIG. 1, the length 26 of the lock bar notch 24 may be much longer than the width 42 of the lock lug 40, depending upon the variance in the position of the lock bar 20 that is tolerable by the switch machine. The length 26 must be short enough to retain the lock bar 20 within tolerable limits of its locking position. On the other hand, the length 26 should be as long as possible without extending beyond those tolerable limits in order to provide the lock lug 40 with plenty of room to position within the lock bar notch 24. By providing the lock lug 40 with as much room as possible, there is a higher probability of locking the lock bar 20 into position and the possibility of the switch machine having a problem condition is minimized.

Figure 2:
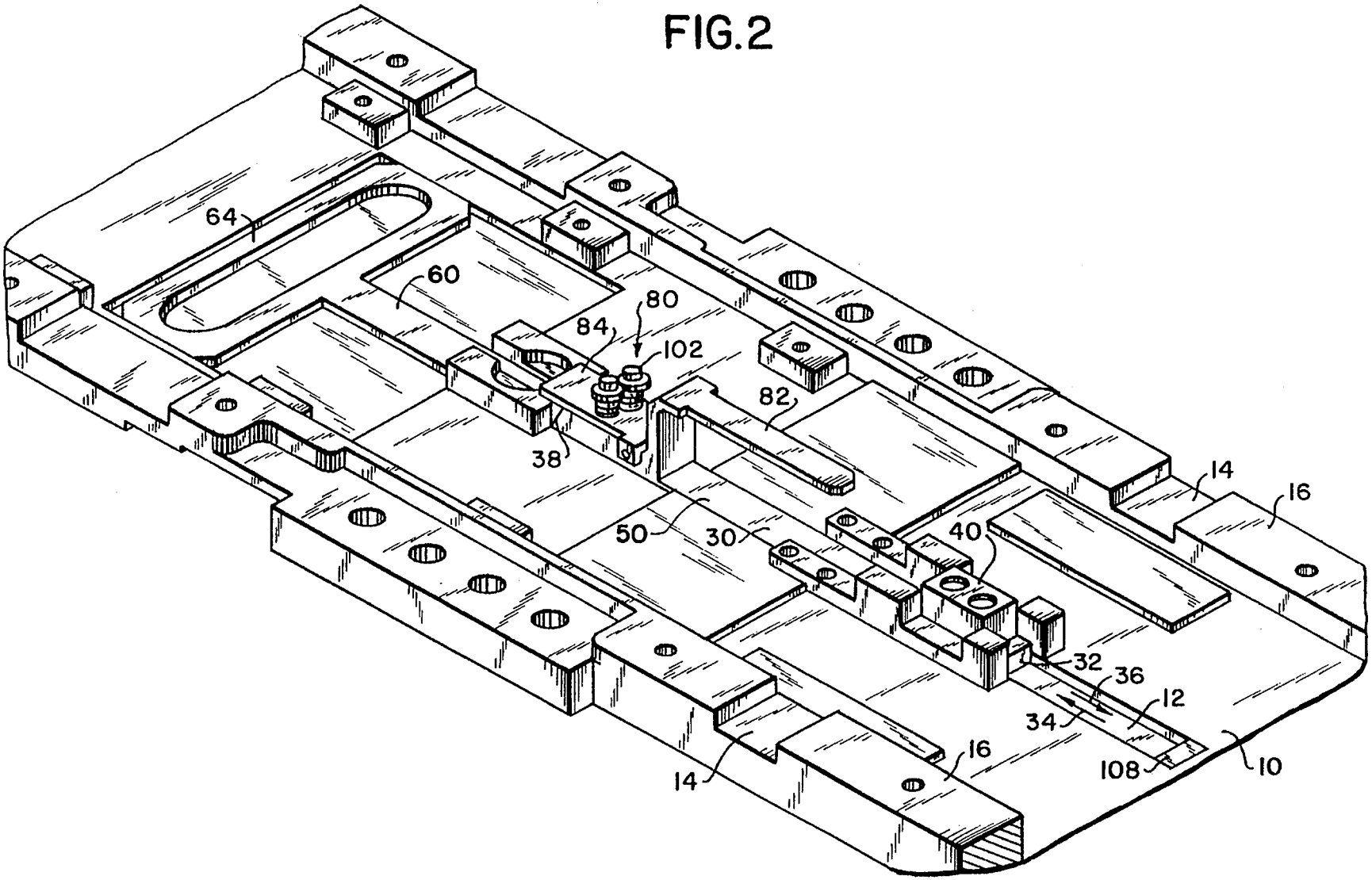
FIG. 2 is another perspective view of the cam bar of FIG. 1, wherein the lock bar has been omitted in order to more clearly show the elements hidden behind the lock bar.

Referring to FIG. 2, the lock bar 20 (of FIG. 1) has been omitted in order to more clearly show the various elements of the cam bar 30 of the preferred embodiment without obstruction by the lock bar. The cam bar 30 is positioned within a base groove 12 of the base plate 10 so that it may slide lengthwise relative to the base plate in either a locking direction 34 and an unlocking direction 36. Also, the cam bar 30 comprises two separate but interlockable sections, namely, a locking section 50 and a positioning section 60. A separation point 38 determines the boundary between the locking section 50 and the positioning section 60 of the cam bar 30.

Figure 3:
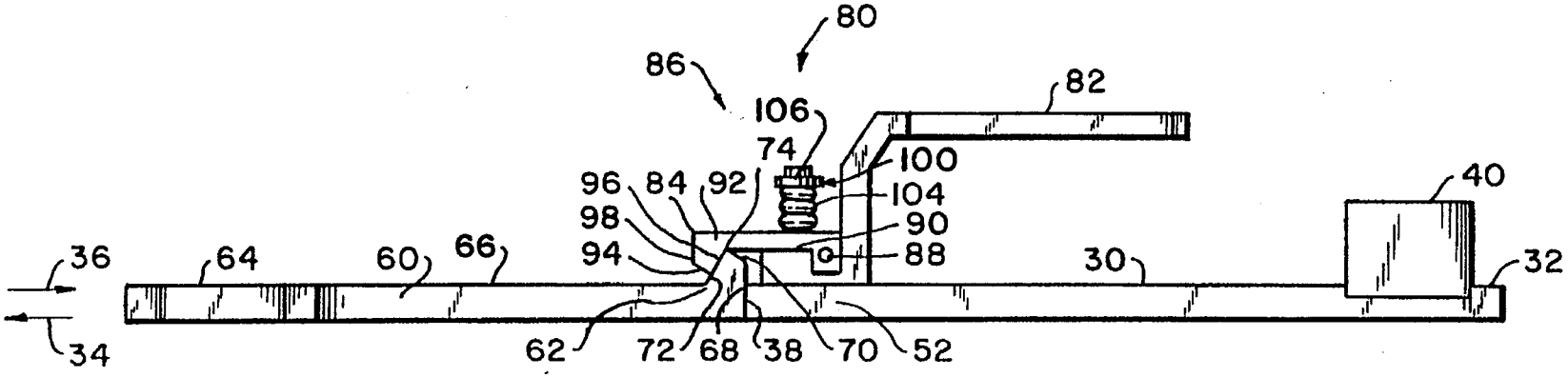
FIG. 3 is an elevation or side view of the cam bar of FIG. 1, without the base plate.

Referring to FIG. 3, a side view of the cam bar 30 of the preferred embodiment is shown, without the base plate 10 (of FIGS. 1 and 2). From the view of FIG. 3, the positioning section 60 is located on the left-hand portion of the cam bar 30 and has a ridge end 62 on the right side and a throwing end 64 on the left side. The throwing end 64 of the positioning section 60 is controlled by a shifting means for sliding the cam bar 30 in the locking and unlocking directions 34, 36 within the base groove 12 (shown in FIGS. 1 and 2), such as a hand throw arm.

The ridge end 62 of the positioning section 60 extends vertically upward from an upper surface 66 of the rest of the positioning section, thereby extending an outer edge 68 of the ridge end upward and forming two sloping edges 70, 72. An upper sloping edge 70 has one end converging with the outer edge 68 that slightly inclines towards another end (going from right to left for FIG. 3) that converges with an inner sloping edge 72, such that the two sloping edges form a peak 74. From the peak 74, the inner sloping edge 72 declines toward the upper surface 66 of the positioning section 60 at an angle that is much steeper than the opposing slope of the upper sloping edge 70.

The locking section is located on the right-hand portion of the cam bar 30, from the view of FIG. 3, and has a lug end 32 on the right side and a connecting end 52 on the left side. The connecting end 52 is positioned adjacent to the ridge end 62 at the separation point 38 in FIG. 3, but the two ends may be separated, as will be explained subsequently. As stated above, the lock lug 40 is positioned at the lug end 32 of the locking section 50. An interlocking means 80 for the locking section 50 to the positioning section 60 is located at the connecting end 52 of the locking section 50.

The interlocking means 80 of the preferred embodiment comprises a point detector arm 82, an interlocking arm 84 and a tension means 100. The point detector arm 82 is the portion of the interlocking means 80 that moves with the positioning section 60 without contacting same. It is understood that the point detector arm 82 provides a supporting base for the rest of the interlocking means 80, but does not otherwise provide any functionality for the purposes of interlocking the locking section 50 to the positioning section 60. Thus, any other type of support for the interlocking means 80 may be substituted for the point detector arm 82. The point detector arm 82 only becomes necessary as described herein for the purposes of preventing an indicator of a point detector system (not shown) from indicating a "safe condition".

The interlocking arm 84 pivots around a pivot point 88 located on the point detector arm 82 and is normally held at a horizontal position between a top surface 90 of the base of the point detector arm and the tension means 100. When the interlocking means 80 is locking or unlocking the positioning section and the locking section, the interlocking arm 84 will first move clockwise around the pivot point 88, thereby compressing the tension means 100. Then, the interlocking arm 84 will move back counter-clockwise, thereby releasing the tension means 100, and returning back to its normal position.

Similar to the ridge end 62 of the positioning section 60, a locking end 92 of the interlocking arm 84 extends vertically downward from the interlocking arm and forms two sloping edges: a lower sloping edge 94 and a connecting edge 96. The lower sloping edge 94 slightly declines downward towards a low point 98 (going from left to right for FIG. 3) where the lower sloping edge and the connecting 96 converge. From the low point 98, the connecting edge 96 inclines back toward the interlocking arm 84 at an angle that is much steeper than the opposing slope of the lower sloping edge 94.

Figure 4:
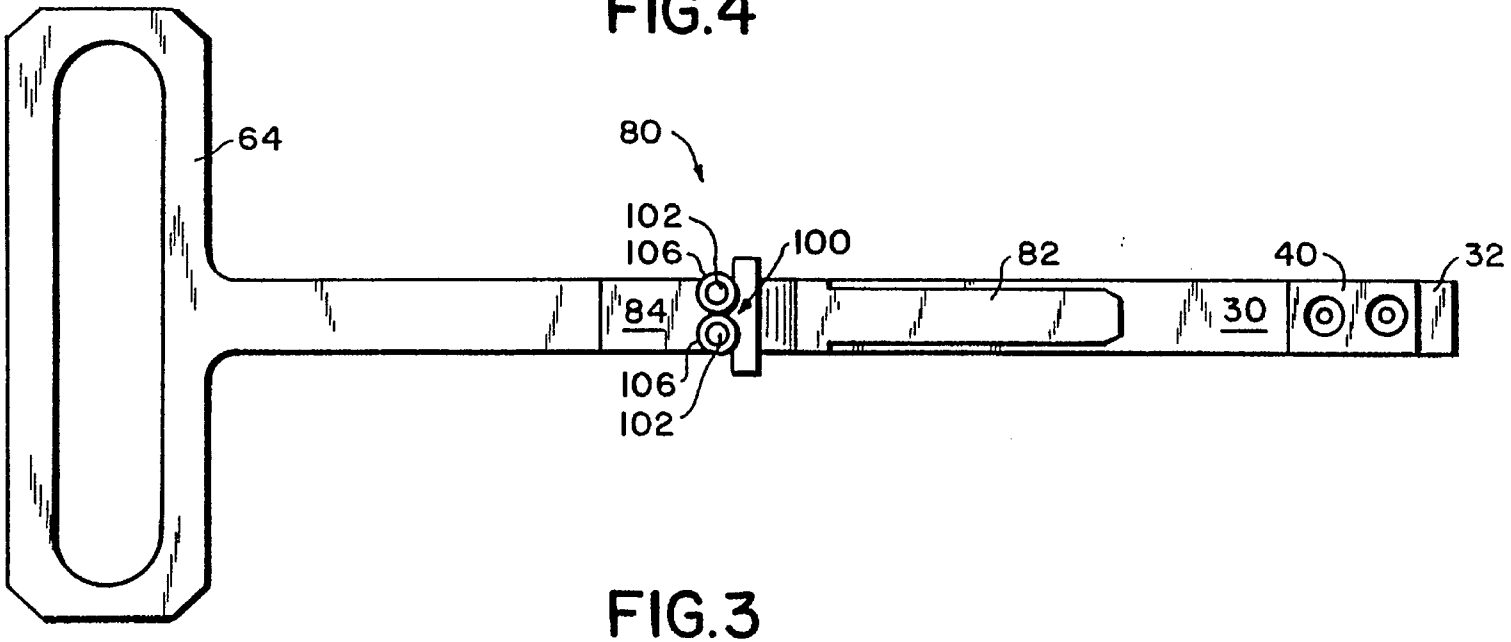
FIG. 4 is a top plan view of the cam bar of FIG. 1, without the base plate.

Referring to both FIGS. 3 and 4, the tension means 100 comprises a pair of shafts 102, a pair of springs 104 and a pair of spring supports 106. Each shaft 102 passes through an opening formed in the interlocking arm 84 and is fixed at the bottom end to the base of the point detector arm 82. At the top of each shaft 102 is a spring support 106 for supporting an upper end of the spring 104. The lower end of each spring 104 abuts the upper surface of the interlocking arm 84, thereby applying a pair of downward forces to the interlocking arm and holding it at its counter-clockwise position against the base of the point detector arm 82.

Referring back to FIG. 1 in combination with FIG. 3, when the switch machine is in operation and in the process of switching railroad tracks, the cam bar 30 travels back and forth in the locking and unlocking directions 34, 36 within the base groove 12. When the switch machine is switching railroad tracks, the initial motion of the cam bar 30 is to move the lock lug 40 out of the lock bar notch 24 in the unlocking direction 36.

The following examples assume problem situations where the cam bar 30 attempts to move in the locking direction 34, but the lock lug 40 does not line up with the lock bar notch 24. In such situations, the lock lug 40 abuts a portion of the lock bar 20 other than the lock bar notch 24 and stops short of a locking position of the cam bar 30. Since full motion of the cam bar 30 has not been completed, the interlocking means 80 allows the positioning section 60 to separate from the locking section 50 by rotating the interlocking arm 84 around the pivot point 88 against the tension means 100. At the same time, the connecting edge 96 of the locking end 92 slides up the inner sloping edge 72 of the ridge end 62, thereby pushing the locking end upward toward the peak 74. The interlocking arm 84 rotates back to its normal position and the lower sloping edge 94 of the locking end 92 slides down the upper sloping edge 70 away from the peak 74 once the locking end clears the peak.

Thus, the hand throw operation can be completed since the throwing end 64 of the positioning section 60 is able to move all-of-the-way back in the locking direction 34. Thus, the hand throw arm may be repositioned into a latch stand and locked into position thereon. Also, the railroad tracks can then be locked into position by positioning a spike through one of the bars or rods of the switch machine or against the railroad tracks themselves. With the hand throw arm and the railroad tracks locked and secured, the operation of the railroad through associated railroad tracks may be resumed until a more permanent repair can be made.

When the problem that prevented the lock bar 20 from locking has been cleared, and the return to normal operation of the switch machine is desired, the switch machine may be cycled by an operator. In other words, an operator may control the switch machine to switch railroad tracks back and forth until it is operating normally. During this process, the cam bar 30 moves in the unlocking direction 36 and the lug end 32 hits the reset lug 108. Then, the interlocking means 80 allows the positioning section 60 to reconnect to the locking section 50 by rotating the interlocking arm 84 around the pivot point 88 against the tension means 100. At the same time, the lower sloping edge 94 of the locking end 92 slides up the upper sloping edge 70, thereby pushing the locking end upward towards the peak 74. The interlocking arm 84 rotates back to its normal position and the connecting edge 96 of the locking end 92 slides down the inner sloping edge 72 away from the peak 74 once the locking end 92 passes over the peak 74 of the ridge end 62.

Optionally, the reset lug 108 can be removed from the end of the base groove 12 in order to prevent the positioning section 60 to reconnect to the locking section 50. This configuration is desirable where it is desired that only maintenance personnel are permitted to reset the interconnection of the two sections 50, 60 of the cam bar 30.

Another safety feature of the preferred embodiment concerns the point detector arm 82. When positioning section 60 is separated from the locking section 50, the point detector arm 82 is not in the correct position required by a point detector system to permit an indicator to indicate a "safe condition". This feature prevents an indication of a false signal when the cam bar 30 is not able to move to its locking position.

The invention having been thus described with particular reference to the preferred forms thereof, it will be obvious that various changes and modifications may be made therein without departing from the spirit and scope of the invention as defined in the appended claims.

Wherefore, we claim:

1. A cam bar comprising:

a positioning section on said cam bar;

a locking section on said cam bar having a particular locking position;

means, located on said locking section, for interlocking said locking section to said positioning section; and said interlocking means being operative to allow said positioning section to automatically separate from said locking section when said locking section is prevented from moving to said locking position.

2. The cam bar of claim 1, further comprising means for locking said locking section at said particular locking position.

3. A cam bar comprising:

a positioning section on said cam bar;

a locking section on said cam bar having a particular locking position;

means, located on said locking section, for interlocking said locking section to said positioning section; and said interlocking means being operative to allow said positioning section to separate from said locking section when said locking section is prevented from moving to said locking position, wherein said positioning section has a first ridge having a linear sloping edge at one end thereof, and said interlocking means has a second ridge having a linear sloping edge that positions over said linear sloping edge said first ridge so that said locking section is capable of interlocking to said positioning section.

4. The cam bar og claim 3, wherein:

said first ridge has a front sloping edge and a back sloping edge;

means for sliding said second ridge up said front sloping edge, and then, for sliding said second ridge down said back sloping edge in order to interlock said locking section to said positioning section; and means for sliding said second ridge up said back sloping edge, and then, for sliding said second ridge down said from sloping edge in order to separate said locking section from said positioning section.

5. The cam bar of claim 4, wherein said second ridge has at least two linear sloping edges that slide over said from sloping edge and said back sloping edge of said first ridge in order to facilitate the interlocking and separating of said locking section and positioning section.

6. The cam bar of claim 3, wherein said interlocking means has tension means for supporting said second ridge toward said first ridge and permitting said second ridge to slide over, and abut against, said first ridge in order to interlock said locking section to said positioning section.

7. The cam bar of claim 3, wherein said second ridge pivots about a pivot point in a counter-clockwise direction in order to interlock, and a clockwise direction in order to separate, said locking section and said positioning section.

8. A cam bar comprising:

a positioning section on said cam bar;

a locking section on said cam bar having a particular locking position;

means, located on said locking section, for interlocking said locking section to said positioning section;

said interlocking means being operative to allow said positioning section to separate from said locking section when said locking section is prevented from moving to said locking position; and an actuator arm located on said locking section for preventing an indicator from indicating a "safe condition" when said locking section is not in said locking position.

9. A switch machine for switching a position of a railroad track, comprising:

a lock bar having a particular locking position in said switch machine; and a cam bar having a positioning section, a locking section separably attached to said positioning section for locking said lock bar at said particular locking position, and means for interlocking said locking section to said positioning section, wherein said interlocking means allows said positioning section to automatically separate from said locking section when said locking section is not able to lock said lock bar at said particular locking position.

10. The switch machine of claim 9, further comprising means for locking said locking section to the lock bar.

11. The switch machine of claim 10, further comprising a notch positioned on said lock bar wherein said locking means is positioned within said notch when said locking section has locked said lock bar at said particular locking position.

12. A switch machine for switching a position of a railroad track, comprising:

a lock bar having a particular locking position in said switch machine; and a cam bar having a positioning section, a locking section separably attached to said positioning section for locking said lock bar at said particular locking position, and means for interlocking said locking section to said positioning section, wherein said interlocking means allows said positioning section to separate from said locking section when said locking section is not able to lock said lock bar at said particular locking position, wherein said positioning section has a first ridge having a linear sloping edge at one end thereof, and said interlocking means has a second ridge having a linear sloping edge that positions over said linear sloping edge said first ridge so that said locking section is capable of interlocking to said positioning section.

13. The switch machine of claim 12, wherein:

said first ridge has a front sloping edge and a back sloping edge;

means for sliding said second ridge up said front sloping edge, and then, for sliding said second ridge down said back sloping edge in order to interlock said locking section to said positioning section; and means for sliding said second ridge up said back sloping edge, and then, for sliding said second ridge down said front sloping edge in order to separate said locking section from said positioning section.

14. The switch machine of claim 13, wherein said second ridge has at least two linear sloping edges that slide over said front sloping edge and said back sloping edge of said first ridge in order to facilitate the interlocking and separating of said locking section and positioning section.

15. The switch machine of claim 12, wherein said interlocking means has tension means for supporting said second ridge toward said first ridge and permitting said second ridge to slide over, and abut against, said first ridge in order to interlock said locking section to said positioning section.

16. The switch machine of claim 12, further comprising means for pivoting said second ridge about a pivot point in a counter-clockwise direction in order to interlock, and a clockwise direction in order to separate, said locking section and said positioning section.

17. A switch machine for switching a position of a railroad track, comprising:

a lock bar having a particular locking position in said switch machine;

a cam bar having a positioning section, a locking section separably attached to said positioning section for locking said lock bar at said particular locking position, and means for interlocking said locking section to said positioning section, wherein said interlocking means allows said positioning section to separate from said locking section when said locking section is not able to lock said lock bar at said particular locking position; and an actuator arm located on said locking section for preventing an indicator from indicating a "safe condition" when said locking section has not locked said lock bar at said particular locking position.

* * * * *